United States Patent [19]

Suzuki

[11] Patent Number: 4,942,799

[45] Date of Patent: Jul. 24, 1990

[54] METHOD OF GENERATING A TONE SIGNAL

[75] Inventor: Hideo Suzuki, Hamamatsu, Japan

[73] Assignee: Yamaha Corporation, Hamamatsu, Japan

[21] Appl. No.: 112,386

[22] Filed: Oct. 22, 1987

[30] Foreign Application Priority Data

Oct. 24, 1986 [JP] Japan ..... 61-251936

[51] Int. Cl.[5] ..... G10H 7/00; G10H 1/06

[52] U.S. Cl. ..... 84/603; 84/621; 84/622; 84/624

[58] Field of Search ..... 84/1.22, 1.24, 1.28, 84/1.01, 1.19, DIG. 9; 364/724, 723, 724.01–724.03, 724.06, 724.08, 724.10; 381/61, 62, 63, 98, 97

[56] References Cited

U.S. PATENT DOCUMENTS

| | | | |
|---|---|---|---|
| 4,003,003 | 1/1977 | Haeberlin | 84/1.01 X |
| 4,270,026 | 5/1981 | Shenoi et al. | 364/723 X |
| 4,383,462 | 5/1983 | Nagai et al. . | |
| 4,461,199 | 7/1984 | Hiyoshi et al. | 84/1.01 |
| 4,472,993 | 9/1984 | Futamase et al. | 84/1.24 |
| 4,616,546 | 10/1986 | Uchiyama et al. | 84/1.19 X |
| 4,701,956 | 10/1987 | Katoh | 84/1.19 X |
| 4,840,100 | 6/1989 | Adachi et al. | 84/622 X |

FOREIGN PATENT DOCUMENTS

| | | | |
|---|---|---|---|
| 1186751 | 5/1985 | Canada | 364/724 |

*Primary Examiner*—A. T. Grimley
*Assistant Examiner*—Matthew S. Smith
*Attorney, Agent, or Firm*—Spensley Horn Jubas & Jubitz

[57] ABSTRACT

A tone generation system and method generates tone signals having complex harmonic components while reducing aliasing noise resulting from sampling of high frequency harmonics.

In a first step, waveshape data which has been sampled with a second sampling frequency which is higher than a first sampling frequency is obtained. Then a predetermined tone synthesis modulation operation is performed, using this waveshape data as at least one of a signal to be modulated and a modulating signal. By performing this modulation operation in accordance with the higher second sampling frequency, occurrence of an aliasing component contained in a tone signal obtained as the output of the modulation operation in a frequency band below a frequency which is ½ of the first sampling frequency can be prevented. Then, the frequency band of the output signal of the modulation operation is limited to a frequency band below the frequency which is ½ of the first sampling frequency. By this arrangement, even if an aliasing noise component concerning the second sampling frequency occurs in a frequency region which is higher than the frequency which is ½ of the first sampling frequency, such aliasing noise component will be eliminated. Lastly the output signal of the third step is resampled with the first sampling frequency. In this manner, in a tone signal generated in response to the resampled signal, an aliasing component concerning the first sampling frequency becomes higher than ½ of the first sampling frequency so that it does not appear as the aliasing noise.

14 Claims, 4 Drawing Sheets

METHOD OF GENERATING A TONE SIGNAL

BACKGROUND OF THE INVENTION

This invention relates to a method of generating a tone signal capable of generating a tone signal having desired tone color characteristics by performing a predetermined tone synthesis modulation operation using, as at least one of a modulated signal and a modulating signal, a complex waveshape signal, e.g., a waveshape signal in which the waveshape is caused to change over plural periods by sampling a tone introduced from outside and, more particularly, to effective prevention of an aliasing noise occurring in such tone signal generation method.

U.S. Pat. No. 4,383,462 discloses generation of a tone signal of high quality closely simulating a tone produced by a natural musical instrument by storing a complete waveshape from start of sounding of a tone to the end thereof or a waveshape of plural periods of a part of the complete waveshape and subsequently reading out the stored waveshape from the memory.

Japanese Preliminary Patent Publication No. 29895/1986 or No. 39097/1986 discloses generation of a tone signal of high quality having desired tone color characteristics by performing a tone synthesis modulation operation, e.g., frequency modulation (hereinafter referred to as "FM") or amplitude modulation (hereinafter referred to as "AM") using a waveshape signal of high quality consisting of a waveshape of plural periods stored in a memory such as one described above. According to this method, it is unnecessary to provide, for each different tone color, a memory of a relatively large memory capacity storing a high quality waveshape consisting of a waveshape of plural periods so that high quality waveshapes can be realized in various tone colors with a single waveshape of high quality stored in a memory.

The above described high quality waveshape consisting of a waveshape of plural periods contains complex harmonic components including harmonic components of high frequencies. In a normal tone signal sampling frequency (e.g., about 50 kHz), therefore, an aliasing noise which is inharmonic with the tone pitch of the tone occurs even in a relatively low frequency region and elimination of this aliasing noise has proved very difficult. It is conceivable, for example, to eliminate aliasing noise in a desired frequency region by employing a filter capable of eliminating the aliasing noise. Since, however, aliasing occurs even in a relatively low frequency region with an aliasing point being at a frequency which is one half of the sampling frequency in the case of the frequency components ranging over a relatively high frequency region contained in a tone signal derived by performing modulation operation using a high quality waveshape signal consisting of a waveshape of plural periods and containing complex harmonic components as described above, setting of the cut-off frequency of the filter at a low frequency for eliminating aliasing noise in such low frequency region results in elimination of a part of proper tone signal component. The mere provision of the noise eliminating filter, therefore, does not provide a solution to the problem of aliasing noise.

For the reason stated above, although, it has been known in the art that a tone signal of high quality having desired tone color characteristics can be generated with a simple construction, it has been difficult to put it to practice due to the above described problem of aliasing noise.

It is therefore an object of the present invention to provide, in the case of generating a high quality tone signal having desired tone color characteristics with a simple construction by performing tone synthesis modulation operation such as FM and AM using a high quality waveshape signal consisting of a waveshape of plural periods, a method of generating a tone signal capable of eliminating the aliasing noise and thereby enabling practical use of such advantageous tone generation technique.

SUMMARY OF THE INVENTION

The method of generating a tone signal according to the invention comprises: first step of obtaining waveshape data which has been sampled with a second sampling frequency which is higher than a first sampling frequency, second step of performing a predetermined tone synthesis modulation operation by using the waveshape data as waveshape data corresponding to at least one of a signal to be modulated and a modulating signal, third step of limiting frequency band of output signal of the modulation operation to a frequency band below a frequency which is ½ of the first sampling frequency, and fourth step of resampling the output signal which has been limited in frequency band in the third step with the first sampling frequency and providing the resampled signal as a tone signal.

The first sampling frequency (denoted by fs1) is constituted of a normal tone signal sampling frequency (e.g., 50 kHz) and the second sampling frequency (denoted by fs2) is constituted of a frequency which is higher than that (e.g., 1 MHz). In the first step, waveshape data which has been sampled by this second sampling frequency fs2 is obtained. In the second step, a predetermined tone synthesis modulation operation is performed by using the sampled waveshape data as waveshape data for at least one of a signal to be modulated and a modulating signal. Since the second sampling frequency fs2 is a high frequency, a tone signal obtained as the operation output contains harmonic components in a substantially high frequency region. An aliasing component sometimes occurs in a low frequency region which is lower than ½ of the second sampling frequency, i.e., fs2/2. However, by establishing the second sampling frequency fs2 at a higher frequency than the first sampling frequency fs1, i.e., performing the tone synthesis modulation operation in accordance with the second sampling frequency fs2 which is higher than the first sampling frequency fs1, occurrence of an aliasing component of a tone signal obtained as the operation output in a frequency region lower than the frequency fs1/2 which is ½ of the first sampling frequency fs1 can be prevented.

In the third step, the frequency band of the output signal of the modulation operation is limited to a frequency band below the frequency fs1/2 which is ½ of the first sampling frequency. By this band limitation, even if an aliasing noise component concerning the second sampling frequency fs2 has occurred in a frequency region higher than ½ of the first sampling frequency fs1, such aliasing noise component is removed. In the fourth step, the tone signal which has been limited in band in the third step is resampled with the first sampling frequency fs1. An aliasing noise component concerning this first sampling frequency fs1 becomes higher than ½ of the first sampling frequency fs1 owing to the band limitation in the third step and therefore does not appear as an aliasing noise.

Thus, the tone signal which has been produced from the output signal in the fourth step does not contain aliasing noise at all.

BRIEF DESCRIPTION OF THE DRAWINGS

In the accompanying drawings.

DESCRIPTION OF PREFERRED EMBODIMENTS

Preferred embodiments of the invention will now be described with reference to the accompanying drawings.

Figure 1:
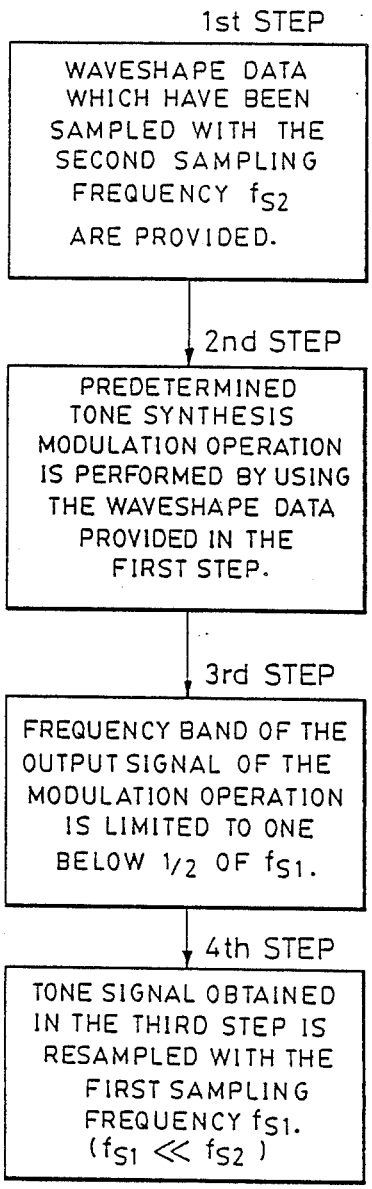
FIG. 1 is a flow chart showing steps of processing in an embodiment of the method of generating a tone signal according to the invention.

FIG. 1 is a flow chart of an embodiment of the method of generating a tone signal according to the invention which comprises the first through fourth steps. A tone signal is produced in accordance with the output signal in the fourth step.

Figure 2A:
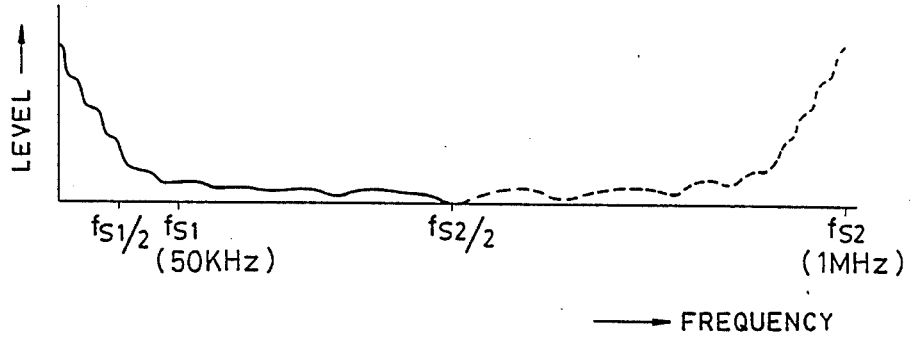
FIGS. 2*a*, 2*b* and 2*c* are diagrams respectively showing an example of spectrum envelope of a signal obtained in each of the above steps.
Figure 2B:
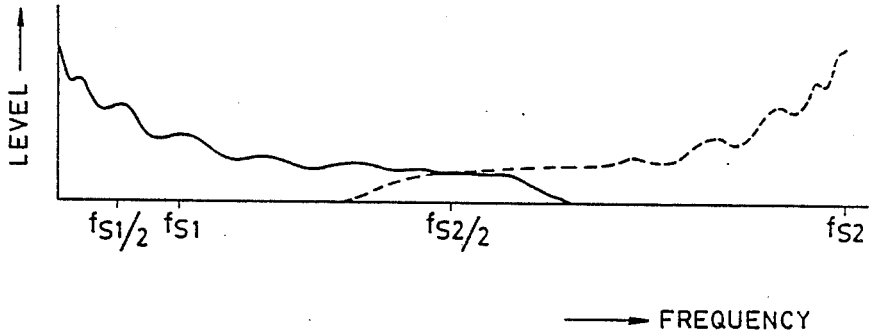

In the first step, waveshape which has been sampled with the second sampling frequency fs2 (e.g., 1 MHz) which is higher than the first sampling frequency (e.g., 50 kHz) is provided. An example of spectrum envelope of the waveshape data obtained in this first step is shown in FIG. 2*a*. In the second step, this waveshape data is used as at least one of a signal to be modulated and a modulating signal to perform a predetermined tone synthesis modulation operation. An example of spectrum envelope of a tone signal obtained by this tone synthesis modulation operation is shown by a solid line in FIG. 2*b*. The tone signal obtained as the operation output contains harmonic components of substantially high frequencies. There sometimes occurs an aliasing component (shown by a dotted line) in a frequency region lower than the frequency fs2/2 which is ½ of the second sampling frequency. However, by establishing the second sampling frequency fs2 at a frequency higher than the first sampling frequency fs1, i.e., by performing the tone synthesis modulation operation with the second sampling frequency fs2 which is higher than the first sampling frequency fs1, occurrence of the aliasing component of the tone signal obtained as the operation output in a frequency region lower than the frequency fs1/2 which is ½ of the first sampling frequency fs1 can be prevented. This can be ensured by establishing the second sampling frequency fs2 at a frequency which is sufficiently higher than the first sampling frequency fs1 so that the aliasing noise component concerning the second sampling frequency contained in the output signal of the modulation operation in the second step will not occur in a frequency region lower than ½ of the first sampling frequency fs1.

Figure 2C:
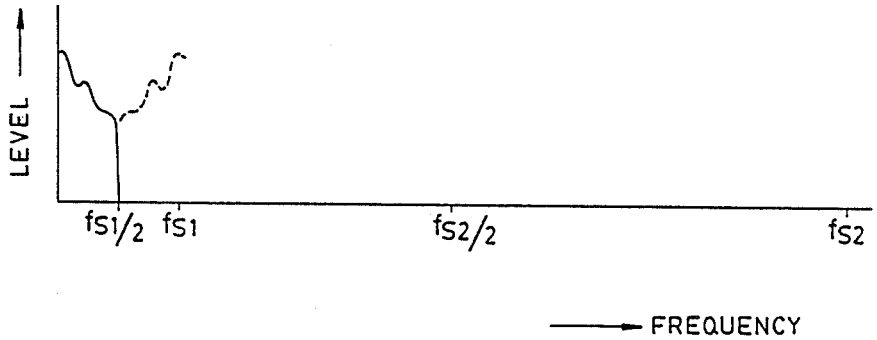

In the third step, the frequency band of the output signal of the modulation operation is limited to one below the frequency fs1/2 which is ½ of the first sampling frequency fs1. An example of spectrum envelope of the tone signal limited in frequency band in the third step is shown by a solid line in FIG. 2*c*. By this band limitation, an aliasing noise component concerning the second sampling frequency fs2 will be removed even if such aliasing noise component occurs in a frequency region higher than ½ of the first sampling frequency fs1. In the fourth step, the tone signal which has been limited in the frequency band in the third step is resampled with the first sampling frequency fs1. An aliasing component concerning the first sampling frequency fs1 becomes higher than ½ of the first sampling frequency fs1 as shown by a dotted line in FIG. 2*c* owing to the band limitation in the third step and therefore does not appear as aliasing noise.

The tone signal produced from the output signal in the fourth step therefore does not contain an aliasing noise at all.

Figure 3:
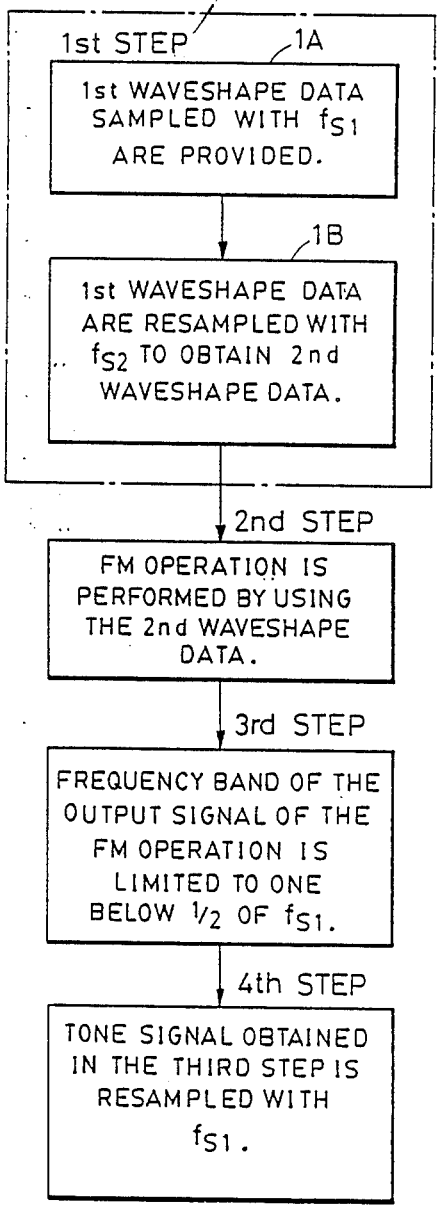
FIG. 3 is a flow chart showing steps of processing in another embodiment of the method of generating a tone signal according to the invention.

FIG. 3 is a flow chart showing another embodiment of the method of generating a tone signal according to the invention. This embodiment differs from the embodiment shown in FIG. 1 in that the first step consists of a step 1A for obtaining first waveshape data which has been sampled with the first sampling frequency fs1 and a step 1B for obtaining second waveshape data by resampling the first waveshape data with the second sampling frequency fs2. The second waveshape data which has been resampled with the second sampling frequency fs2 is used as waveshape data for at least one of a signal to be modulated and a modulating signal in the tone synthesis modulation operation in the second step.

Figure 4:
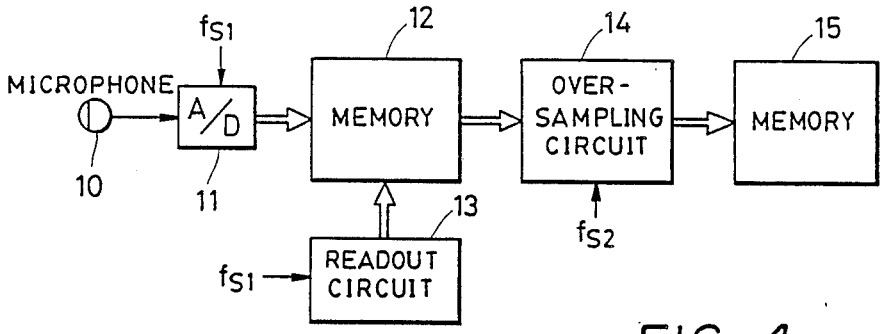
FIG. 4 is a block diagram showing an example of a device used out the first step of FIG. 3.

The first step of FIG. 3 can be carried out by employing a device as shown in FIG. 4. A desired tone (e.g., a tone of a desired natural musical instrument) is introduced from outside through a microphone 10 and a signal of the introduced tone is converted to a digital signal while being sampled with the first sampling frequency fs1 (e.g., 50 kHz) by an analog-to-digital conversion circuit 11. The converted digital signal is stored in a first memory 12. Waveshape data stored in this memory 12 is read out by a readout circuit 13 which performs reading operation in accordance with the first sampling frequency fs1. The waveshape data read out from the memory 12 is supplied to an oversampling circuit 14 in which the waveshape data is resampled with the second sampling frequency fs2 (e.g., 1 MHz) which is much higher than the first sampling frequency fs1. The resampled waveshape data is stored in a second memory 15. The waveshape data thus sampled and stored in the memory 15 in the first step corresponds to a complete waveshape from start of sounding of a tone to the end thereof or a waveshape of plural periods of a part or parts of the complete waveshape and is data of high quality whose waveshape changes with time.

Figure 5:
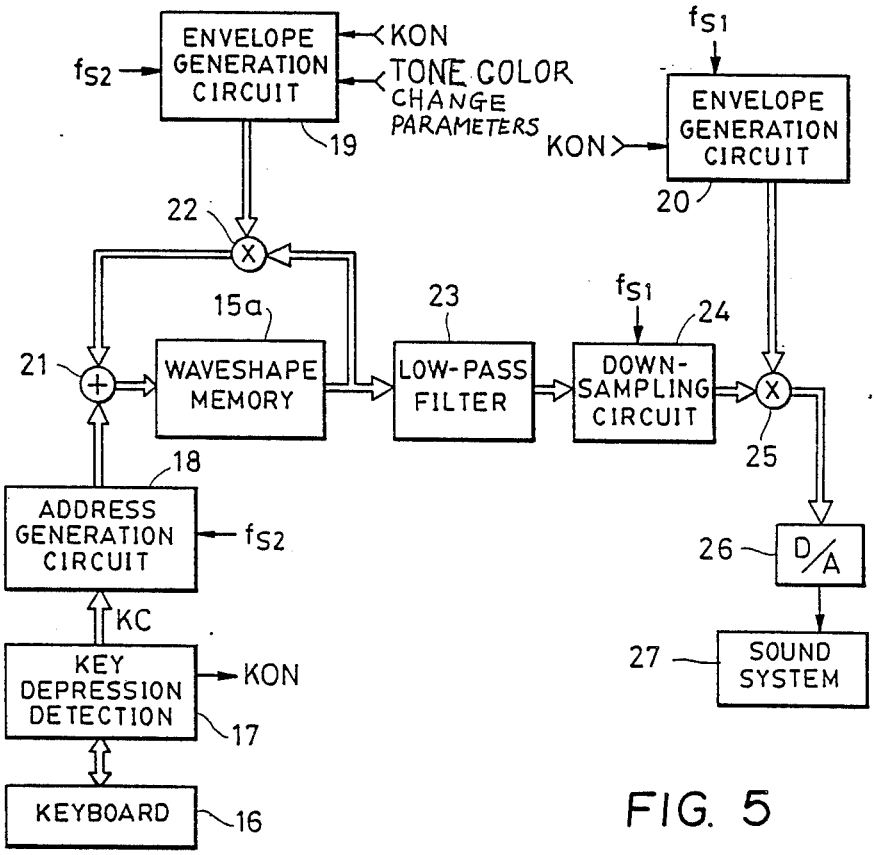
FIG. 5 a block diagram showing an example of a device used for carrying out the second through fourth steps of FIG. 3.

The second, third and fourth steps of FIG. 3 can be carried out by employing a device as shown in FIG. 5. A waveshape memory 15*a* stores the same waveshape data as one stored in the second memory 15 in FIG. 4. In the device of FIG. 5, the second, third and fourth steps (i.e., tone synthesis modulation operation, band limitation of modulation output and resampling of the data to the lower sampling frequency fs1) are implemented in real time in accordance with tone generation selection operation.

Upon depression of a key designating a desired tone pitch in a keyboard 16, a key code KC and a key-on signal KON for the depressed key are provided from key depression detection circuit 17. The key code signal KC is supplied to an address generation circuit 18 and the key-on signal KON to envelope generation circuits 19 and 20. The address generation circuit 18 generates phase data PD which changes in accordance with the tone pitch of the supplied key code KC. This phase data PD is supplied to an address input of a waveshape memory 15*a* through an adder 21. A read out output of the waveshape memory 15*a* is applied to another input of the adder 21 through a multiplier 22 and fed back to the address input. The waveshape memory 15*a*, adder 21 and multiplier 22 constitute a self-feedback type FM operation circuit in which the phase data PD constitutes phase data of a signal to be modulated and the output of the multiplier 22 constitutes modulating signal data. What is supplied to the multiplier 22 from the envelope generation circuit 19 in accordance with the key-on signal KON is modulation index data. A desired tone color change can be achieved by controlling this modulation index in accordance with tone color change parameters. As the tone color change parameters, the tone pitch and touch data of a tone to be generated or an output signal of a desired operation knob can be utilized. In the foregoing manner, a self-feedback type FM operation using the waveshape data stored in the waveshape memory 15*a* as the modulated signal and the read out output of the waveshape memory 15*a* as the modulating signal is carried out.

The output of the waveshape memory 15*a*, i.e., FM operation output, is supplied to a low-pass filter 23. The cut-off frequency of this low-pass filter 23 is established at a frequency lower than ½ of the first sampling frequency fs1 (i.e., fs1/2 =25 kHz) whereby frequency components contained in the FM operation output signal are limited to a frequency band below this cut-off frequency.

The circuits from the address generation circuit 18 to the low-pass filter 23 are operated in synchronism with high rate sampling frequency fs2 =1 MHz so that stored waveshape data of the waveshape memory 15*a* which is sampled with this high rate sampling frequency fs2 can be read out without difficulty.

Figure 6A:
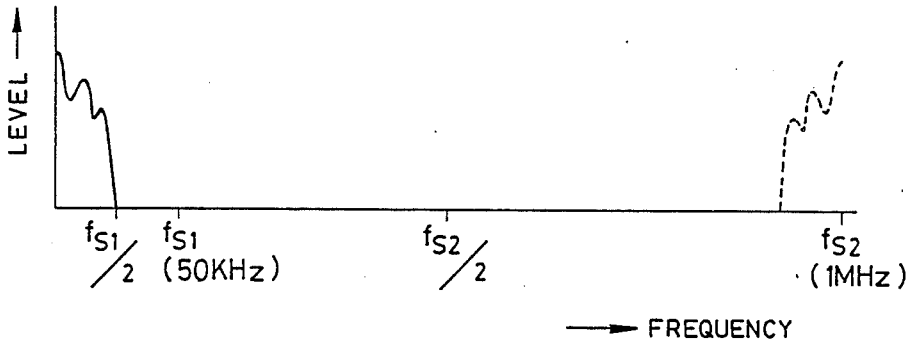
FIGS. 6*a*, 6*b* and 6*c* are diagrams respectively showing an example of spectrum envelope of a signal obtained in each of the above steps.

The output of the low-pass filter 23 is applied to a down sampling circuit 24 and resampled therein with low rate sampling frequency fs1. The output of the downsampling circuit 24 is supplied to a multiplier 25 where it is multiplied with a tone envelope signal generated by the envelope generation circuit 20 in accordance with the key-on signal KON. The output of the multiplier 25 is supplied to a digital-to-analog converter 26 and thereafter to a sound system 27. An example of spectrum envelope of the waveshape data obtained in the first step (waveshape data stored in the memory 15 or the waveshape memory 15*a*) is shown in FIG. 6*a*. This spectrum envelope is limited to a frequency band below fs1/2 =25 kHz by initially sampling with the low sampling frequency fs1 in the processing of the step 1A of FIG. 3. For this reason, even after resampling of the waveshape data with the high rate sampling frequency fs2 =1 MHz by the processing in the next step 1B, the aliasing component thereof occurs only in a relatively high frequency region in the vicinity of 1 MHz as shown by a dotted line in FIG. 6*a*. Accordingly, this prevents occurrence of an aliasing noise in a low frequency region. Besides, initial sampling of the waveshape data with the low sampling frequency fs1 as in this embodiment is beneficial in that it alleviates burden relating to the operation speed of the analog-to-digital conversion circuit 11 (FIG. 4) used for sampling and thereby enabling simplification of this circuit 11 with resulting reduction of the manufacturing cost.

Figure 6B:
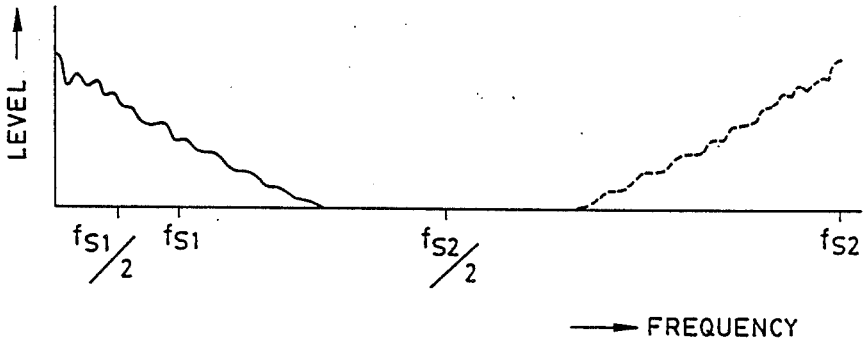

FIG. 6*b* shows an example of spectrum envelope of FM operation output signal (output signal of the waveshape memory 15*a*). The FM operation causes harmonic components in the output signal to extend to the high frequency region. Since, however, the waveshape stored in the waveshape memory 15*a* is limited to the frequency band below fs1/2 =25 kHz and the high rate sampling frequency fs2 for the FM operation is established at a frequency much higher than the low rate sampling frequency fs2, prevention of occurrence of aliasing component in the tone signal obtained as the operation output in a frequency region below the frequency fs1/2 which is ½ of the low rate sampling frequency fs1 will be ensured.

Figure 6C:
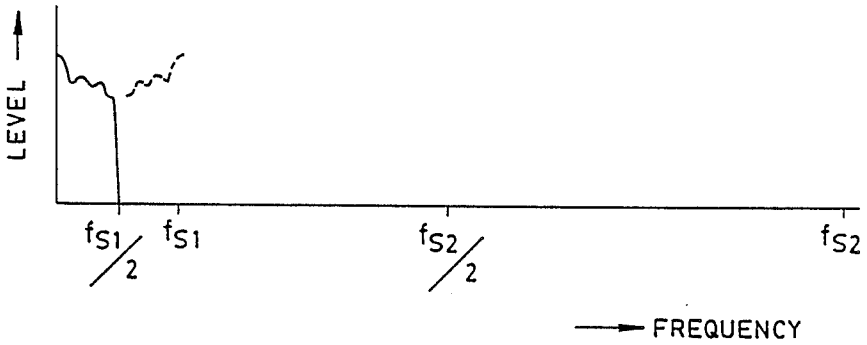

FIG. 6*c* shows an example of spectrum envelope of the tone signal which has been limited in the frequency band by the low-pass filter 23. By this band limitation, even if harmonic components in the FM operation output signal extend to a frequency region which is higher than the frequency fs1/2 which is ½ of the low rate sampling frequency fs1 as shown in FIG. 6*b*, the high frequency components are cut off. By this band limitation, even if the sampling frequency of a tone signal is converted to the low rate sampling frequency fs1 by a down sampling circuit 24 provided in the next step, an aliasing component concerning this low rate sample frequency fs1 becomes higher than ½ of the low rate sampling frequency fs1 as shown by a dotted line in FIG. 6*c* and does not appear as the aliasing noise.

In the above described embodiment, the processings in the second, third and fourth steps (tone synthesis modulation operation, band limitation of the modulation output and resampling to the low rate sampling frequency fs1) are performed in real time by the device shown in FIG. 5 in accordance with the tone generation selection in the keyboard 16. The processings of these steps however are not limited to these. For example, the tone signal (i.e., output signal of the down sampling circuit 24) obtained in the fourth step may be stored in a waveshape memory and the stored signal may be read out in accordance with the tone generation selection (performance) in the keyboard or the like.

As a mode of carrying out the present invention, a device for implementing the processings of the second, third and fourth steps as shown in FIG. 5 may be incorporated in an electronic musical instrument while various kinds of waveshape data which have been prepared by a manufacturer of the electronic musical instrument are stored in the waveshape memory 15*a* in the electronic musical instrument by using the device as shown in FIG. 4 and the processing of the first step may be carried out by the manufacturer of the electronic musical instrument while the processings of the second, third and fourth steps are implemented by the performer. In that case, the kind of waveshape data to be read out from the waveshape memory 15*a* may be selected by a tone color selection knob or other suitable operation means. Alternatively, the devices as shown in FIGS. 4 and 5 may be incorporated together in an electronic musical instrument and the performer may freely carry out the processings of the first through fourth steps.

In FIG. 5, a circuit construction performing the self feedback type FM operation is employed as the tone synthesis modulation operation circuit. The tone synthesis modulation operation circuit, however, is not limited to this. For example, the waveshape data (i.e., the stored data in the waveshape memory 15) obtained in the first step may be used as one of modulating signal and a signal to be modulated and other suitable waveshape signal may be used as the other of the modulating signal and the signal to be modulated. The modulation operation system is not limited to the FM operation but the AM operation or other system may be employed.

The invention is applicable not only to generation of scale notes but also to generation of rhythm sounds and other audio sounds.

As described in the foregoing, according to the invention, in a case where the tone synthesis modulation operation such as FM and AM is performed by using a high quality waveshape signal consisting of a waveshape of plural periods to generate a high quality tone signal having desired tone color characteristics with a simple construction, the problem of aliasing noise which is likely to occur by extension of harmonic components in the modulation operation output signal to a high frequency region can be eliminated whereby the invention will contribute to reduction to practice of the advantageous tone generation technique.

What is claimed is:

1. A method of generating a tone signal comprising:

a first step of obtaining waveshape data which has been sampled with a predetermined sampling frequency which is the higher of a first sampling frequency and a second sampling frequency;

a second step of performing a predetermined tone synthesis modulation operation to generate spectrum components by using said waveshape data as waveshape data corresponding to at least one of a signal to be modulated and a modulating signal;

a third step of limiting the frequency band of the output signal of said modulation operating to a frequency band below a frequency which is ½ of the lower of said first and second sampling frequencies; and a fourth step of resampling the output signal which has been limited in frequency band in said third step with the lower of said first and second sampling frequencies and providing the resampled signal as a tone signal;

2. A method of generating a tone signal as defined in claim 1 wherein said predetermined sampling frequency is sufficiently higher than said lower sampling frequency so that an aliasing-noise component concerning this predetermined sampling frequency contained in the output signal of the modulating operation in said second step will not occur in a frequency band below a frequency which is ½ of said lower sampling frequency.

3. A method of generating a tone signal as defined in claim 1 wherein said first step comprises a step of obtaining first waveshape data which has been sampled with the lower sampling frequency and a step of obtaining second waveshape data by resampling this first waveshape data with said predetermined sampling frequency.

4. A method of generating a tone signal as defined in claim 3 wherein, in said first step, said first waveshape data is obtained by sampling a signal of a tone introduced from outside with said lower sampling frequency.

5. A method of generating a tone signal as defined in claim 3 wherein the waveshape data to be sampled in said first step is waveshape data consisting of a waveshape of plural periods.

6. A method of generating a tone signal as defined in claim 1 wherein, in said first step, said waveshape data is obtained by sampling a signal of a tone introduced from outside with said predetermined sampling frequency.

7. A method of generating a tone signal as defined in claim 1 wherein the waveshape data obtained in said first step is stored in a memory, said waveshape data is read out from this memory in accordance with phase data of the signal to be modulated or phase data of the modulating signal corresponding to a desired tone pitch and the modulation operation is performed is real time in correspondence to this readout in said second step, and the output of said modulation operation is processed in real time thereby to generate a tone signal corresponding to the desired tone pitch in said third and fourth steps.

8. A method of generating a tone signal as defined in claim 1 wherein waveshape data corresponding to the output signal of said fourth step is stored in a memory, this waveshape data is read out from this memory in accordance with a desired tone pitch and a tone signal is generated in response to the read out output.

9. A tone signal generation device comprising:

a waveshape memory storing waveshape data which has been sampled with a predetermined sampling frequency which is the higher of a first sampling frequency and a second sampling frequency;

tone pitch designation means for designating a tone pitch of a tone to be generated;

phase data generation means for repeatedly generating phase data which changes in accordance with the tone pitch designated by said tone pitch designation means at a sampling timing corresponding to said predetermined sampling frequency;

modulation operation means for performing a predetermined tone synthesis modulation operation by accessing said waveshape memory, using the phase data generated by said phase data generation means as at least one of a signal to be modulated and a modulating signal;

a low-pass filter receiving the output signal of said modulation operation means and timing its frequency band to a frequency band below ½ of the lower of said first and second sampling frequencies; and down sampling means for resampling the output signal of said low-pass filter with the lower of said first and second sampling frequencies to provide the resampled signal as a tone signal.

10. A tone signal generation device as defined in claim 9 wherein said predetermined sampling frequency is sufficiently higher than the lower of said first and second sampling frequencies so that an aliasing noise component concerning said predetermined sampling frequency contained in the output signal of said modulation operation means will not occur in a frequency band below a frequency which is ½ of the lower of said first and second sampling frequencies.

11. A tone signal generation device as defined in claim 9 wherein said modulation operation means performs frequency modulation operation.

12. A tone signal generation device as defined in claim 9 wherein said modulation operation means performs amplitude modulation operation.

13. A tone signal generation device as defined in claim 9 further comprising:

first sampling means for sampling a signal of a tone introduced from outside with the first sampling frequency and storing the sampled data as first waveshape data;

readout means for reading out the first waveshape data stored in said first sampling means in accordance with the first sampling frequency; and second sampling means for resampling the first waveshape data read out from said readout means with a second sampling frequency which is higher than said first sampling frequency and storing the resampled data as second waveshape data, said second waveshape data obtained by said second sampling means being stored in said waveshape memory.

14. A method of generating a tone signal comprising the steps of:

synthesizing a musical tone waveshape via a certain waveshape synthesis arithmetic at a high sampling frequency, said musical tone waveshape including higher harmonic components having frequencies more than $\frac{1}{2}$ of a lower sampling frequency which is rather lower in frequency tan said higher sampling frequency;

performing a harmonic generation operation which generates desired harmonic components and which also generates undesired components higher than said higher sampling frequency;

eliminating all of most of said higher harmonic components via performing a filtering operation on said musical tone waveshape; and resampling and the outputting the filtered musical tone waveshape of said lower sampling frequency.

* * * * *